US010725415B2

(12) United States Patent
Yamanaka

(10) Patent No.: US 10,725,415 B2
(45) Date of Patent: Jul. 28, 2020

(54) IMAGE FORMING APPARATUS AND IMAGE FORMING METHOD

(71) Applicant: CANON KABUSHIKI KAISHA, Tokyo (JP)

(72) Inventor: Shinichi Yamanaka, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/386,513

(22) Filed: Apr. 17, 2019

(65) Prior Publication Data

US 2019/0332048 A1 Oct. 31, 2019

(30) Foreign Application Priority Data

Apr. 25, 2018 (JP) ..... 2018-084182
Mar. 6, 2019 (JP) ..... 2019-040916

(51) Int. Cl.
*G03G 15/00* (2006.01)

(52) U.S. Cl.
CPC ..... *G03G 15/5029* (2013.01); *G03G 15/6579* (2013.01); *G03G 15/5062* (2013.01)

(58) Field of Classification Search
CPC ..... G03G 15/65; G03G 15/5029; G03G 15/6502; G03G 15/6514; G03G 2215/00362; G03G 2215/00556; G03G 2215/00586; G03G 2215/00717
See application file for complete search history.

(56) References Cited

U.S. PATENT DOCUMENTS

2006/0133844 A1* 6/2006 Konno ..... B41J 3/60 399/82

FOREIGN PATENT DOCUMENTS

JP 2009-154540 A 7/2009

* cited by examiner

*Primary Examiner* — Thomas S Giampaolo, II
(74) *Attorney, Agent, or Firm* — Venable LLP

(57) ABSTRACT

The printer includes an image forming unit which forms an image on a sheet and a media sensor which detects a characteristic of the sheet. If the characteristics of the sheet do not support automatic double-sided printing, the printer forms an image on the first side of the sheet and discharges the sheet to an FD sheet discharge portion or an FU sheet discharge portion. After discharging the sheet, the printer instructs a user to place the discharged sheet on a cassette or a manual feed tray. If the sheet having the image formed on the first side is placed on the cassette or the manual feed tray, the printer forms an image on a second side of the sheet.

11 Claims, 11 Drawing Sheets

IMAGE FORMING APPARATUS AND IMAGE FORMING METHOD

BACKGROUND OF THE INVENTION

Field of the Invention

The present disclosure relates to an image forming apparatus such as a copier, a printer, a facsimile, and the like.

Description of the Related Art

The image forming apparatus can form an image on various types of recording materials. Hereinafter, the recording material will simply be described as a "sheet". The image forming apparatus may include a sensor (hereinafter referred to as a "medium sensor") to determine a type of sheet. The image forming apparatus performs optimum image forming processing according to the type of sheet determined by using the media sensor. The image forming processing includes fixing control for fixing the image to the sheet, and conveyance control for conveying the sheet inside the image forming apparatus.

The conveyance control according to a detection result of the media sensor includes processing to determine whether or not a sheet supports automatic double-sided printing when double-sided printing in which printing is performed on front and back sides of one sheet of sheet is set, and if it is determined that the sheet supports the automatic double-sided printing, the sheet is continuously conveyed. For example, Japanese Patent Application Laid-Open No. 2009-154540 discloses a printing device which performs one sided printing on two sheets of sheet if it is determined that the sheet does not support the automatic double-sided printing according to the detection result of the media sensor. In the printing device disclosed, an image to be formed on the front side and an image to be formed on the back side are printed in this order on two sheets.

In the printing apparatus disclosed in Japanese Patent Application Laid-Open Patent publication No. 2009-154540, although a user desires the double-sided printing, the user obtains the two sheets on which one side is respectively printed as a result. Thus, the user cannot obtain the desired result. In addition, as the number of printed sheets increases, resources are consumed. The present disclosure provides an image forming apparatus which performs the double-sided printing while suppressing the consumption of sheets even if the sheet does not support the automatic double-sided printing in performing the double-sided printing.

SUMMARY OF THE INVENTION

An image forming apparatus configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the image forming apparatus comprising: a feeder configured to feed the recording material; an image forming unit configured to form an image on the recording material according to image data; a discharge tray to which the recording material with the image formed is discharged; a detector configured to detect a characteristic of the recording material fed by the feeder; and a controller configured to determine whether the recording material supports the double-sided printing or not based on a detection result of the detector for the recording material fed by the feeder; wherein the controller is further configured to control the image forming unit to form an image of an even-numbered page of the print job on the first side of the recording material in an order of page number, to discharge a recording material with an image formed on a first side to a discharge tray, to prompt a user to place the discharged recording material on a feeder for second side printing, and to control the image forming unit to form an image of an odd-numbered page on the second side of the recording material with the image formed on the first side which is fed from the feeder for the second side printing if it is determined that double-sided printing is specified by the print job and the recording material does not support the double-sided printing based on a detection result of the detector.

Further features of the disclosure will become apparent from the following description of exemplary embodiments (with reference to the attached drawings).

DESCRIPTION OF THE EMBODIMENTS

The image forming apparatus according to the present invention will be described with reference to the drawings.

Hardware Configuration

Figure 1:
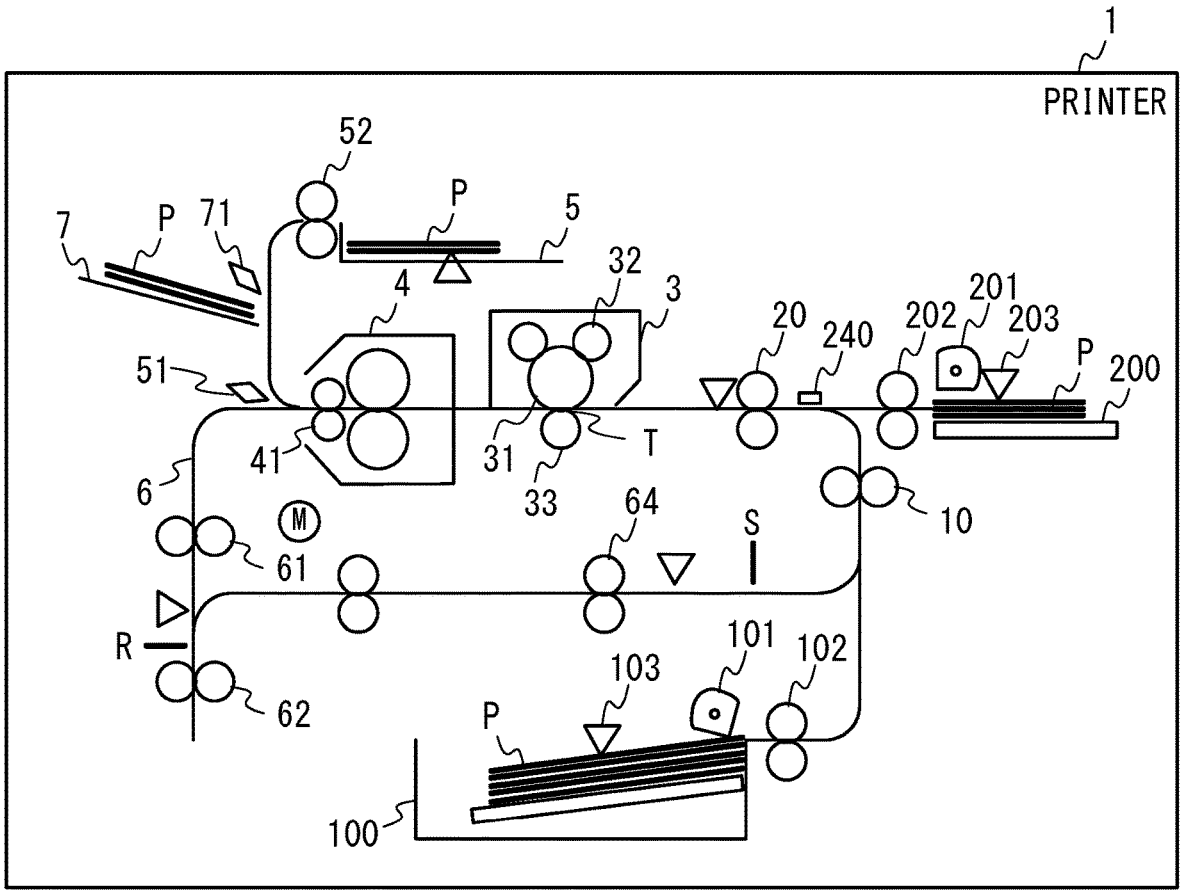
FIG. 1 is a configuration diagram of a printer.

FIG. 1 is a configuration diagram of a laser printer (hereinafter simply referred to as a "printer"), which is an example of an image forming apparatus according to the present embodiment. A printer 1 includes an image forming part 3, a fixing device 4, a sheet feeding portion (feeder) for feeding a sheet P which is a recording material, and a sheet discharge portion (discharge tray) to which the sheet P having the image formed thereon is discharged.

The image forming part 3 includes, for example, an image carrier 31 formed of a photosensitive member 1 and a developing device 32. The developing device 32 develops, using toner, an electrostatic latent image formed on the image carrier 31 by charging processing and exposure processing etc. In this way, a toner image is formed on the image carrier 31. A transfer roller 33 is provided at a position opposite to the image carrier 31 across a conveying path through which the sheet P is conveyed. A transfer part T in which the toner image is transferred from the image carrier 31 to the sheet P is constituted between the image carrier 31 and the transfer roller 33. The image carrier 31 is rotating. By the rotation of the image carrier 31, the formed toner image is conveyed to the transfer part T. The fixing device 4 fixes the toner image on the sheet P having the toner image transferred thereto in the transfer part T. For example, the fixing device 4 heats and melts the toner, and pressurizes the toner to thermally press the toner image on the sheet P.

The sheet feeding portion of the present embodiment includes a cassette 100 and a manual feed tray 200 as a plurality of sheet feeding ports. The cassette 100 is provided on a lower side of a housing of the printer 1. The manual feed tray 200 is provided on a side part of the housing of the printer 1. In the present embodiment, the sheet discharge portion includes an FD (Face Down) sheet discharge portion 5 and an FU (Face Up) sheet discharge portion 7 as a plurality of sheet discharge ports. The FD sheet discharge portion 5 is a sheet discharge portion to which an image side of a single-sided printed sheet or a front side (a first side) of a double-sided printed sheet is discharged in a state facing downward. The FU sheet discharge portion 7 is a sheet discharge portion to which an image side of a single-sided printed sheet or a front side (a first side) of a double-sided printed sheet is discharged in a state facing upward. A conveying path through which the sheet P is conveyed from the sheet feeding portion to the sheet discharge portion is provided. Various rollers for conveying the sheet P are provided in the conveying path. The image forming part 3 and the fixing device 4 are provided along the conveying path.

The cassette 100 has a function of detecting a size of the sheet P to be stored. The cassette 100 includes a cassette sheet presence/absence sensor 103 for detecting presence or absence of the sheet P to be stored. The cassette 100 is provided with a cassette sheet feeding roller 101 on a conveying path side. The sheet P to be stored in the cassette 100 is separated and fed to the conveying path one by one by the cassette sheet feeding roller 101 and a separation roller (not shown). The sheet P fed from the cassette 100 is conveyed to a registration roller unit 20 by a cassette conveying roller 102 and a conveying roller 10 provided in the conveying path.

The manual feed tray 200 does not have the function of detecting the size of the sheet P placed on the tray. The manual feed tray 200 includes a manual feed tray sheet presence/absence sensor 203 for detecting the presence or absence of the sheet P to be placed. In the present embodiment, 100 sheets can be set in the manual feed tray 200. The manual feed tray 200 includes a manual feed tray sheet feeding roller 201 on the conveying path side. The sheet P placed on the manual feed tray 200 is separated and fed to the conveying path one by one by the manual feed tray sheet feeding roller 201 and a separation roller (not shown). The sheet P fed from the manual feed tray 200 is conveyed to the registration roller unit 20 by a manual feed tray conveying roller 202 provided in the conveying path.

A media sensor 240 is provided on an upstream side of the registration roller unit 20 in a conveying direction of the sheet P after the conveying path from the cassette 100 and the conveying path from the manual feed tray 200 are merged. The media sensor 240 detects characteristics such as the type and thickness (basis weight) of the sheet P which is conveyed along the conveying path. According to a detection result of the media sensor 240, it is determined whether the sheet P being conveyed supports the double-sided printing or not.

The registration roller unit 20 stops rotation when the sheet P is conveyed. The registration roller unit 20 corrects a skew of the sheet P and transfers the sheet P to the transfer part T in synchronization with timing at which the toner image formed on the image carrier 31 is conveyed to the transfer part T. When the toner image is transferred in the transfer part T and the toner image is fixed by the fixing device 4, the image is formed on the sheet P. The sheet P on which the image is formed is conveyed from the fixing device 4 to the downstream side in a conveying direction by a fixing conveying roller 41 of the fixing device 4.

A branch flapper 51 is provided on the downstream side in a conveying direction of the fixing device 4. The branch flapper 51 distributes the sheet P to either a discharge path for discharging the sheet P out of the machine or a double-sided conveying part 6 for reversing the front and back sides of the sheet P in performing the double-sided printing. A branch flapper 71 is provided in the discharge path. The branch flapper 71 distributes the sheet P to either the FD sheet discharge portion 5 or the FU sheet discharge portion 7. If the sheet P is distributed to the FD sheet discharge portion 5 side by the branch flapper 71, the sheet P is discharged and stacked on the FD sheet discharge portion 5 in a printing order by a sheet discharge roller 52. When the sheet P is distributed to the FU sheet discharge portion 7 side by the branch flapper 71, the sheet P is discharged and stacked on the FU sheet discharge portion 7 in the printing order.

The double-sided conveying part 6 includes a double-sided conveying roller 61, a reversing roller 62, and a sheet re-feeding roller 64. If the double-sided printing is set, the double-sided conveying part 6 reverses the front and back sides of the sheet on which the image is printed on the first side on the conveying path, and feeds the sheet for second side printing. In particular, the sheet P on which the image is formed on the first side is conveyed by the branch flapper 51 to the double-sided conveying part 6, and the sheet P is delivered to the double-sided conveying roller 61. The double-sided conveying roller 61 conveys the sheet P to the reversing roller 62. The reversing roller 62 stops the rotation when a rear end of the sheet P in the conveying direction passes through the double-sided conveying roller 61 and reaches a predetermined sheet reversing position R. Thereafter, by rotating reversely, the reversing roller 62 reverses the sheet P and conveys the sheet P to the sheet re-feeding roller 64. The sheet re-feeding roller 64 conveys the sheet P. When a leading end of the sheet P reaches a sheet re-feeding standby position S, the sheet re-feeding roller 64 stops the rotation. It is noted that the double-sided conveying part 6 has difficulty in conveying a sheet having a predetermined basis weight or more due to a curvature of a bending part of the conveying path. Therefore, the sheet having the predetermined basis weight or more means the sheet which does not support the automatic double-sided printing.

At a timing when the printing of the second side can be performed, the sheet re-feeding roller 64 resumes the rotation and conveys the sheet P to the registration roller unit 20. Image formation is performed on the sheet P conveyed to the registration roller unit 20 in the same manner as that performed on the first side. The sheet P having the image formation completed on the second side is distributed to the discharge path by the branch flapper 51. Then, the sheet P is discharged to one of the discharge destinations of the FD sheet discharge portion 5 and the FU sheet discharge portion 7.

Controller

Figure 2:
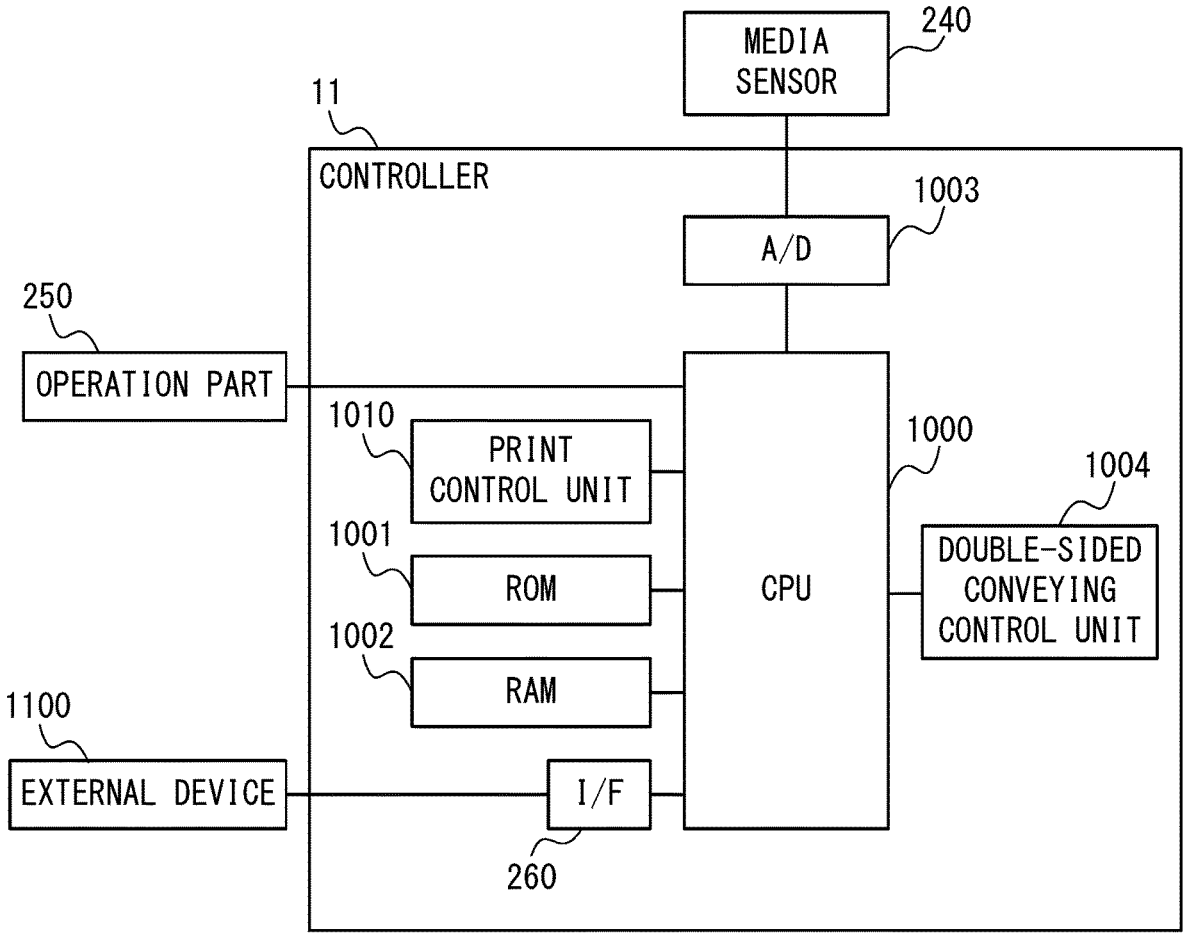
FIG. 2 is a configuration diagram of a controller.

FIG. 2 is a configuration diagram of a controller which controls operation of the printer 1 as described above. A controller 11 includes a central processing unit (CPU) 1000, a read only memory (ROM) 1001, and a random access memory (RAM) 1002. The CPU 1000 controls the operation of the printer 1 by performing a computer program stored in the ROM 1001 by using the RAM 1002 as a working area. The controller 11 includes a print control unit 1010, an A/D converter 1003, a double-sided conveying control unit 1004, and an interface (I/F) 260.

The I/F 260 performs communication control with an external device 1100 such as a personal computer. The I/F 260 comprises, for example, a universal serial bus (USB), a local area network (LAN), a modem, and the like. The I/F 260 acquires a print job including image data representing the image to be formed from the external device 1100. The I/F 260 transmits the acquired print job to the CPU 1000. The CPU 1000 develops the image data included in the print job to bit data used for printing by the printer 1 (image formation) and the CPU 1000 controls the operation of the printer 1 according to the print job by the print control unit 1010. The image data of the present embodiment represents the image of a plurality of pages.

Figure 3:
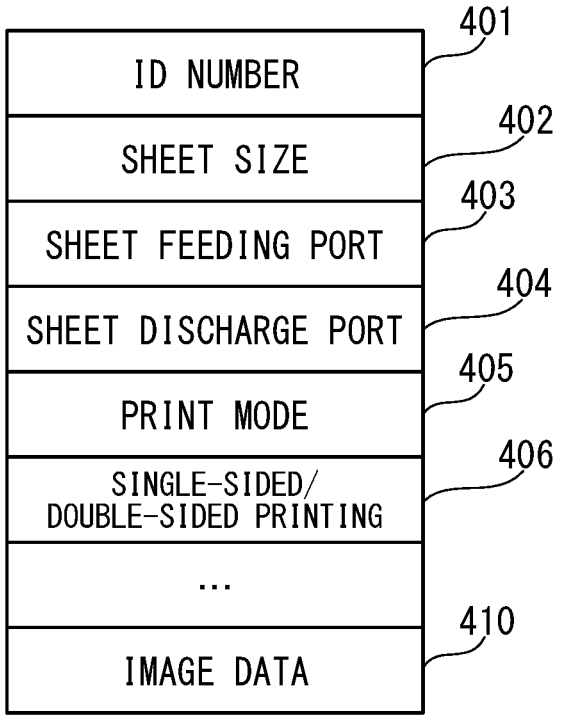
FIG. 3 is an explanatory diagram of a print job.

FIG. 3 is an explanatory diagram of the print job. The print job includes an ID number 401, sheet size data 402, sheet feeding port data 403, sheet discharge port data 404, print mode data 405, single-sided/double-sided print data 406, and image data 410. The print job is one packet including various information in printing the image according to the image data 410. The CPU 1000 having acquired the print job from the I/F 260 stores the print job in the RAM 1002.

The ID number 401 is information for identifying the image data. The sheet size data 402 includes information specifying the size of the sheet to be printed in millimeters. The sheet feeding port data 403 includes information specifying a sheet feeding port (cassette 100, manual feed tray 200) which feeds the sheet on which the image is to be formed. The sheet discharge port data 404 includes information specifying a discharge destination (FD sheet discharge portion 5, FU sheet discharge portion 7) for discharging the sheet having the image formed thereon. The print mode data 405 is information for specifying the control according to the basis weight of the sheet or the type of the sheet. The print mode data 405 includes a thin paper mode, a plain paper mode, a thick paper mode, an auto mode, and the like corresponding to the characteristics of the sheet. The single-sided/double-sided print data 406 is information for specifying whether to perform the single-sided printing or the double-sided printing on the sheet.

The print control unit 1010 controls the operation of the printer 1 by the control of the CPU 1000. The print control unit 1010 performs a series of high pressure control such as conveyance control, charging processing, development processing, transfer processing, and the like of the sheet P, scanner motor control, optical system control such as a laser beam, and the like, and fixing control. The print control unit 1010 detects an operation state of these loads. The CPU 1000 can perform failure detection of each load according to a predetermined condition from the operation state of each load detected by the print control unit 1010.

The double-sided conveying control unit 1004 performs the conveyance control of the sheet P which is performed in the double-sided conveying part 6 in performing the double-sided printing on the sheet P by the control of the CPU 1000. The A/D converter 1003 performs an analog to digital conversion of the detection result to be output from the media sensor 240 and transmits the converted digital signal to the CPU 1000. As described above, the media sensor 240 detects the type and the thickness (basis weight) of the sheet P. The digital signal represents the type and the thickness (basis weight) of the sheet P detected by the media sensor 240. The CPU 1000 uses the digital signal of the detection result obtained for the fixing control and the conveyance control by the print control unit 1010.

An operation part 250 has a function as a user interface and includes an input device and an output device. The input device is, for example, an input key, a numeric keypad, a touch panel, and the like. The output device is a display, a speaker, and the like. The operation part 250 can perform various settings of the printer 1 by the input device. In addition, the operation part 250 can input various information in printing the image included in the above-mentioned print job by the input device. The operation part 250 displays an input screen of the print job, a screen indicating a progress state of the printing, various setting screens, and the like by the output device.

Embodiment 1 of Image Forming Processing

Figure 4:
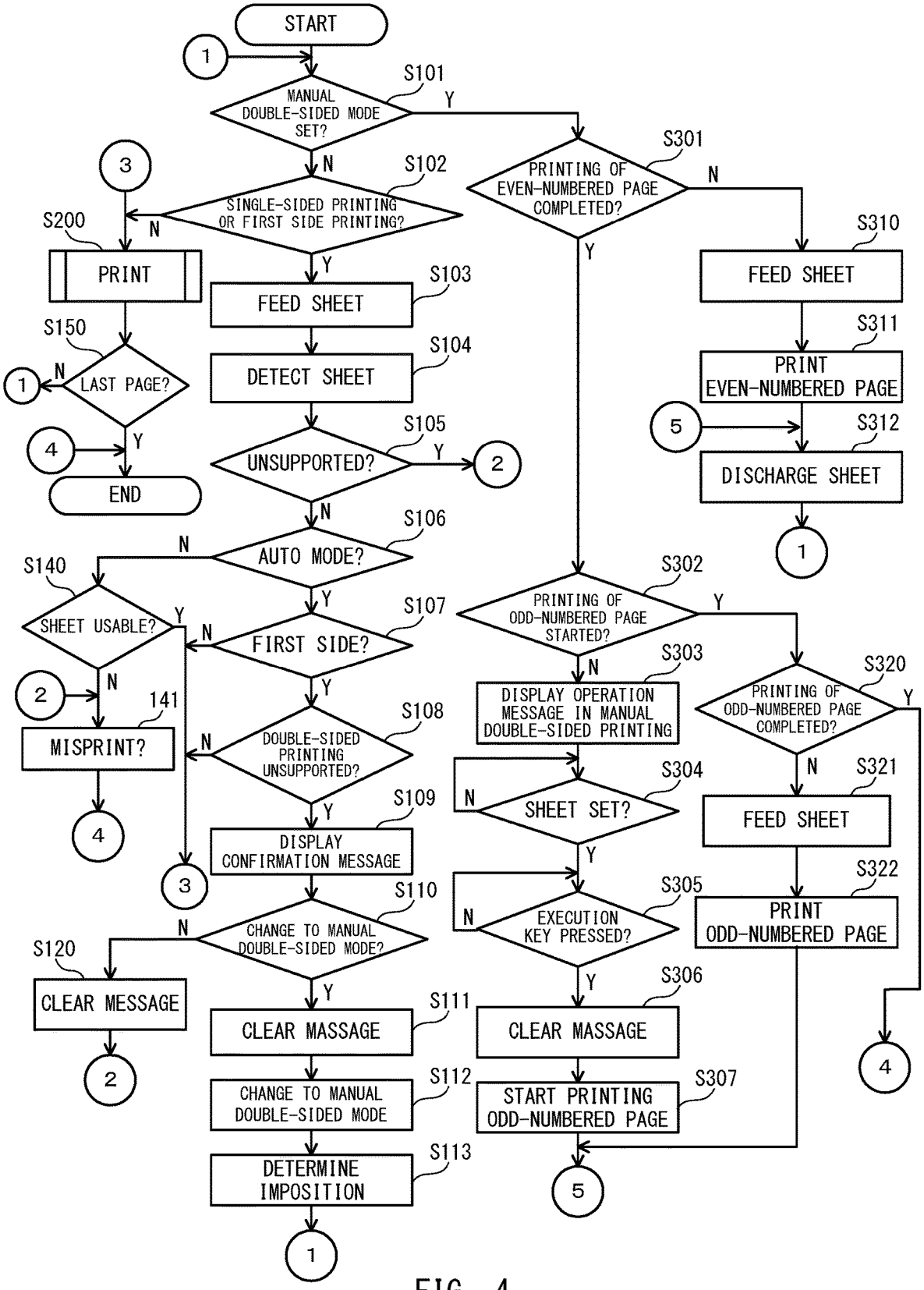
FIG. 4 is a flow chart showing image forming processing.

FIG. 4 is a flow chart showing an image forming processing (printing processing) by the printer 1 with such a configuration. This processing is started when the CPU 1000 acquires the print job from the operation part 250 or the external device 1100. The CPU 1000 stores the acquired print job in the RAM 1002 and performs the processing according to the stored print job. In this processing, the CPU 1000 determines the type of the sheet P from the detection result of the media sensor 240. If the sheet P does not support the double-sided printing, the CPU 1000 displays an operation message on the output device of the operation part 250. The printer 1 outputs the printing product according to a user's response to the operation message.

To this end, the CPU 1000 first determines whether the manual double-sided mode is set or not (Step S101). The manual double-sided mode is a print mode of performing the double-sided printing in which a user manually moves the sheet from the sheet discharge port to the manual feed tray 200 after one side (first side) is printed and then, the other side (second side) is printed according to the user's instruction. If the double-sided printing is instructed by the print job and the sheet does not support the double-sided printing, the CPU 1000 sets the manual double-sided mode according to the user's instruction.

If it is determined that the manual double-sided mode is not set (Step S101: N), the CPU 1000 determines whether the single-sided printing is performed or the printing of the first side in the double-sided printing is performed by the image forming processing (printing processing) which is performed this time (Step S102). The CPU 1000 makes this determination by the single-sided/double-sided print data 406 stored in the RAM 1002.

Figure 5:
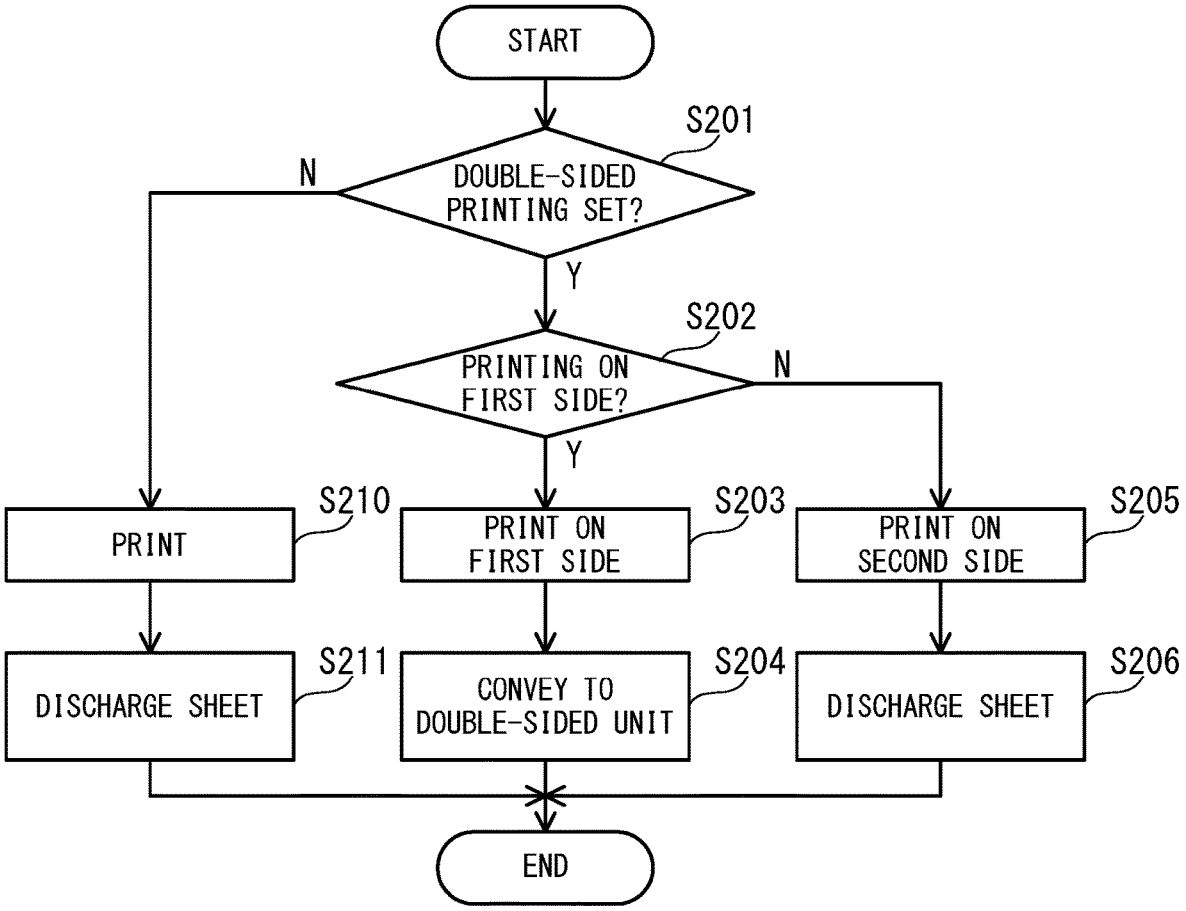
FIG. 5 is a flow chart showing normal printing processing.

If it is determined that the printing of the second side in the double-sided printing is performed (Step S102: N), the CPU 1000 starts normal printing processing (Step S200). FIG. 5 is a flow chart showing the printing processing performed in the processing of the step S200.

The CPU 1000 determines which of the single-sided printing and the double-sided printing is specified by the single-sided/double-sided print data 406 of the print job stored in the RAM 1002 (Step S201). If it is determined that the single-sided printing is specified (Step S201: N), the CPU 1000 performs the single-sided printing processing based on the image data included in the print job by the print control unit 1010 (Step S210). The CPU 1000 discharges the printed sheet P to the discharge port which is specified by the sheet discharge port data 404 of the print job by the print control unit 1010 (Step S211).

If it is determined that the double-sided printing is specified (Step S201: Y), the CPU 1000 determines whether the printing of this time is the printing of the first side of the sheet P or not (Step S202). If it is determined that the printing of this time is the printing of the first side (step S202: Y), the CPU 1000 performs the printing processing on the first side based on the image data included in the print job by the print control unit 1010 (Step S203). The CPU 1000 conveys the sheet P having the first side printed to the double-sided conveying part 6 by the print control unit 1010 (Step S204). If it is determined that the printing of this time is the printing of the second side (S202: N), the CPU 1000 performs the printing processing on the second side based on the image data included in the print job by the print control unit 1010 (Step S205). The CPU 1000 discharges the printed sheet P to the discharge port which is specified by the sheet discharge port data 404 of the print job by the print control unit 1010 (Step S206). The printing processing of the step S200 is performed as described above.

If the printing processing is completed, the CPU 1000 determines whether the printing of the last page is completed or not by the print job (Step S150). If it is determined that the printing of the last page is not completed (Step S150: N), the CPU 1000 repeatedly performs the processing after the step S101. If it is determined that the printing of the last page is completed (Step S150: Y), the CPU 1000 ends the processing.

If it is determined that the single-sided printing is performed or the printing of the first side in the double-sided printing is performed (Step S102: Y), the CPU 1000 confirms which of the cassette 100 and the manual feed tray 200 is used to feed the sheet by the sheet feeding port data 403 of the print job stored in the RAM 1002. Here, a case where the cassette 100 is set in the sheet feeding port data 403 will be described. The CPU 1000 feeds the sheet from the cassette 100 which is specified by the sheet feeding port data 403 by the print control unit 1010 (Step S103). This starts the sheet feeding by the printer 1.

The CPU 1000 acquires the detection result of the media sensor 240 to detect the type and the basis weight of the sheet P fed (Step S104). The CPU 1000 stores the type and the basis weight of the detected sheet P in the RAM 1002. According to the basis weight of the detected sheet P, the CPU 1000 determines whether or not the sheet P being conveyed supports the single-sided printing or the printing of the first side in the double-sided printing (Step S105). The basis weight supported by the single-sided printing or the printing of the first side in the double-sided printing is stored in the ROM 1001 in advance. The CPU 1000 determines whether or not the sheet P being conveyed supports the single-sided printing or the printing of the first side in the double-sided printing by the basis weight detected by the media sensor 240 and the basis weight supported by the single-sided printing or the printing of the first side in the double-sided printing stored in the ROM 1001. In the present embodiment, an upper limit of the basis supported by the single-sided printing or the printing of the first side in the double-sided printing is set to 199 g/m$^2$.

If it is determined that the sheet P being conveyed does not support the single-sided printing or the printing of the first side in the double-sided printing (Step S105: Y), the CPU 1000 determines that it is misprinted (Step S141). If the CPU 1000 determines that it is the misprint, the CPU 1000 stops printing and gives warning representing that the printing is stopped by the operation part 250. Thereafter, the CPU 1000 ends the processing.

If it is determined that the sheet P being conveyed supports the single-sided printing or the printing of the first side in the double-sided printing (Step S105: N), the CPU 1000 determines whether or not the auto mode is specified in the printing mode data 405 of the print job (Step S106). The auto mode is a print mode in which the print mode (thin paper mode, plain paper mode, or thick paper mode) corresponding to the type of sheet is not set by the user and the CPU 1000 automatically performs the fixing control and the conveyance control according to the detection result of the media sensor 240.

If it is determined that the auto mode is not specified (Step S106: N), the CPU 1000 operates in the print mode specified by the user. The CPU 1000 determines whether or not the sheet being conveyed is the sheet which can be used in the specified print mode from the print mode specified in the print job and the detection result of the media sensor 240 (Step S140). If it is determined that the sheet cannot be used (Step S140: N), CPU 1000 determines that the misprint is occurred (Step S141). If the CPU 1000 determines that it is the misprint, the CPU 1000 stops printing and gives warning representing that the printing is stopped by the operation part 250. Thereafter, the CPU 1000 ends the processing. If it is determined that the sheet can be used (Step S140: Y), the CPU 1000 performs the single-sided printing or performs the printing of the first side in the double-sided printing (Step S200).

If it is determined that the auto mode is specified (Step S106: Y), the CPU 1000 determines whether or not it is the first side in the double-sided printing by the single sided/double-sided print data 406 of the print job (Step S107). If it is determined that it is not the first side in the double-sided printing (Step S107: N), the CPU 1000 performs the single-sided printing (Step S200).

If it is determined that it is the first side in the double-sided printing (Step S107: Y), the CPU 1000 reads the basis weight of the sheet P detected by the media sensor 240 from the RAM 1002. The CPU 1000 compares the basis weight supported by the double-sided printing recorded in the ROM 1001 with the basis weight detected by the media sensor 240 and determines whether or not the sheet P being conveyed is supported for the double-sided printing (Step S108). In the present embodiment, the basis weight of the sheet supported for the double-sided printing is up to the upper limit of 120 g/m$^2$. If it is determined that the sheet P being conveyed is supported for double-sided printing (Step S108: N), the CPU 1000 performs the printing of the first side in the double-sided printing (Step S200).

The present embodiment features in that even if the sheet is a sheet having the basis weight which exceeds the upper limit of the basis weight supported by the automatic double-sided printing (120 g/m$^2$), by operating in the manual double-sided mode, it is possible to obtain the product of the double-sided printing. For example, even if the basis weight of the sheet is 150 g/m$^2$ which is not supported for the automatic double-sided printing, the product of the double-sided printing can be obtained by the procedure after the step S109 described below.

Figure 6A:
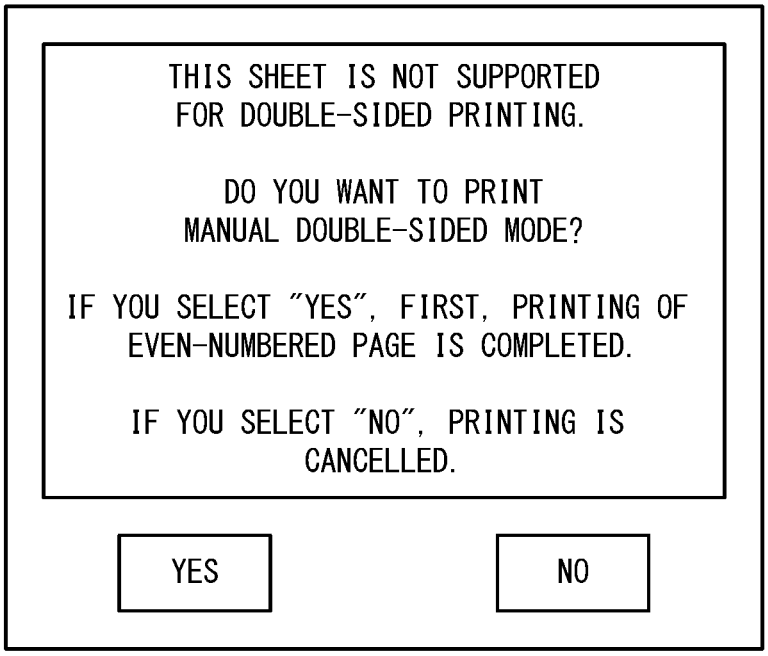
FIG. 6A and FIG. 6B are diagrams each illustrating a message.
Figure 6B:
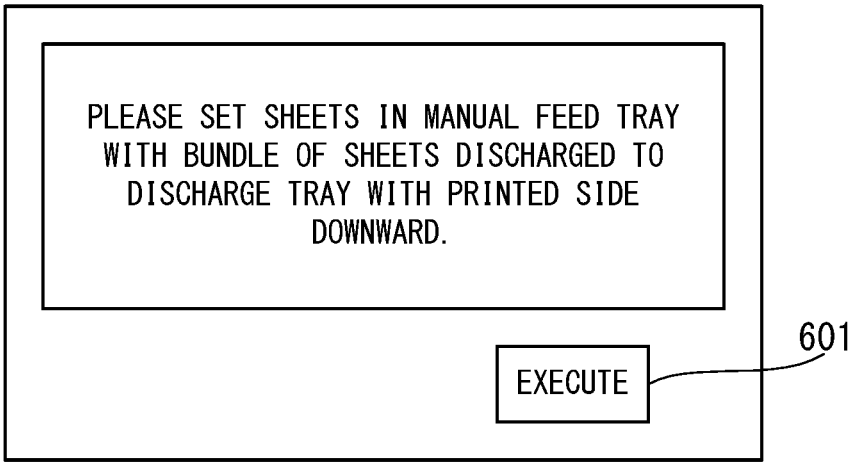

If it is determined that the sheet P being conveyed is not supported for the double-sided printing (Step S108: Y), the CPU 1000 displays a confirmation message on the operation part 250 (Step S109). FIG. 6A and FIG. 6B are diagrams each illustrating a message to be displayed on the operation part 250. In the processing of the step S109, the message shown in FIG. 6A is displayed. FIG. 6A shows the confirmation message notifying the user of the fact that the sheet P does not support the double-sided printing and the processing for performing the double-sided printing. In the present embodiment, the confirmation message notifies the user of the fact that "the sheet is a sheet which does not support the double-sided printing" and that "the product of the double-sided printing can be obtained in the manual double-sided mode". The user instructs the CPU 1000 whether to change the print mode to the manual double-sided mode or not by selecting "Yes" or "No" in the confirmation message (Step S110).

If "No" is selected and the change to the manual double-sided mode is not instructed (Step S110: N), the CPU 1000 clears the confirmation message displayed on the operation part 250 (Step S120). After clearing the confirmation message, the CPU 1000 determines that the misprint is occurred (Step S141). If the CPU 1000 determines that it is the misprint, the CPU 1000 stops printing and gives warning representing that the printing is stopped by the operation part 250. Thereafter, the CPU 1000 ends the processing.

If "Yes" is selected and the change to the manual double-sided mode is instructed (Step S110: Y), the CPU 1000 clears the confirmation message displayed on the operation part 250 (Step S111). After clearing the confirmation message, the CPU 1000 changes the print mode to the manual double-sided mode (Step S112). The CPU 1000 stores the information indicating that the print mode is changed to the manual double-sided mode in the RAM 1002.

The CPU 1000 determines a printing order of each page of the image data included in the print job (imposition) according to the discharge destination of the printed sheet P (Step S113). The CPU 1000 stores determined imposition information in the RAM 1002. In the manual double-sided mode, the printer 1 of the present embodiment performs the printing of an even-numbered page of the image data and then, performs the printing of an odd-numbered page of the image data. In the normal double-sided printing (automatic double-sided printing), the imposition is performed so that the even-numbered page and the odd-numbered page are alternatively printed.

Figure 7A:
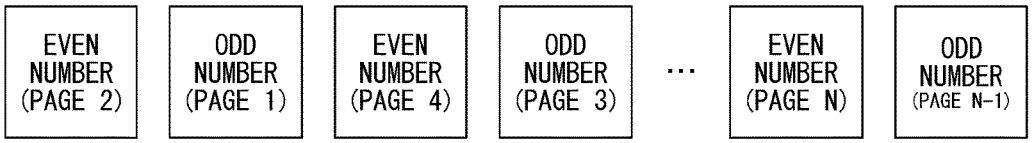
FIG. 7A, FIG. 7B, and FIG. 7C are diagrams for explaining imposition.
Figure 7B:
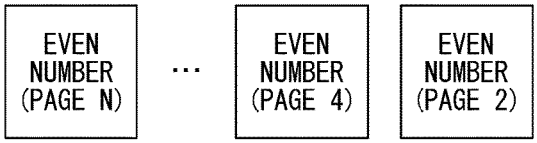
Figure 7C:
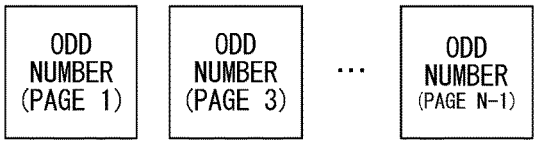
Figure 8A:
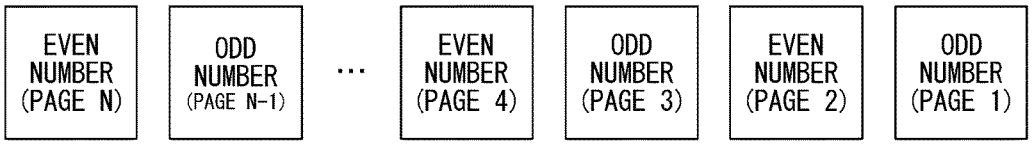
FIG. 8A, FIG. 8B, and FIG. 8C are diagrams for explaining the imposition.

FIG. 7A through FIG. 7C, and FIG. 8A through FIG. 8C are explanatory diagrams of the imposition. FIG. 7A and FIG. 8A show the imposition in the normal double-sided printing and indicate the number of sheets required for the printing. N represents a last page number of the image data. FIG. 7B and FIG. 7C and FIG. 8B and FIG. 8C represent the imposition in the manual double-sided printing of the present embodiment. The discharge destination of the sheet P differs between the imposition shown in FIG. 7A through FIG. 7C and the imposition shown in FIG. 8A through FIG. 8C.

FIG. 7A through FIG. 7C show the imposition when the sheet P after the double-sided printing is discharged to the FD sheet discharge portion 5. FIG. 7A shows the imposition when the automatic double-sided printing is performed on the sheet which supports the double-sided printing. The image data is assigned in the order of the even-numbered page to the odd-numbered page from the smaller page number. FIG. 7B and FIG. 7C show the imposition in the manual double-sided printing of the present embodiment. In FIG. 7B, the image data in the first side printing is rearranged to the even-numbered page from the larger page number. In a configuration in which exposure of the image for the first sheet is started before the type of the sheet P is determined by the media sensor 240, if it is determined that the sheet P is a sheet which does not support the double-sided printing, the toner image which is already formed on the image carrier 31 is erased and the printing is performed according to the imposition changed. In FIG. 7C, the image data in the second side printing is rearranged to the odd-numbered page from the smaller page number.

Figure 8B:
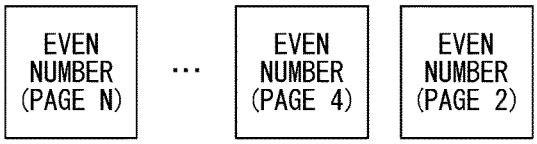
Figure 8C:
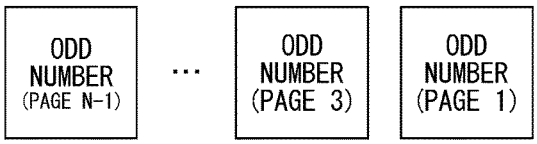

FIG. 8A through FIG. 8C shows the imposition when the sheet P after the double-sided printing is discharged to the FU sheet discharge portion 7. FIG. 8A shows the imposition when the automatic double-sided printing is performed on the sheet which supports the double-sided printing. The image data is assigned in the order of the even-numbered page to the odd-numbered page from the larger page number. FIG. 8B and FIG. 8C shows the imposition in the manual double-sided printing of the present embodiment. In FIG. 8B, the image data in the first side printing is rearranged to the even-numbered page from the larger page number. In the configuration in which the exposure of the image for the first sheet is started before the type of the sheet P is confirmed by the media sensor 240, if it is determined that the sheet P is a sheet which does not support the double-sided printing, the toner image for the first sheet which is already formed on the image carrier 31 can be used as it is. In FIG. 8C, the image data in the second side printing is rearranged to the odd-numbered page from the larger page number.

After the imposition is determined, the CPU 1000 again determines whether the manual double-sided mode is set or not (Step S101). Here, in the processing of the step S112, the print mode is changed to the manual double-sided mode. Since the manual double-sided mode is set (Step S101: Y), the CPU 1000 determines whether or not the printing of the even-numbered page of the image data is completed according to the print job (Step S301). The CPU 1000 performs the printing of the even-numbered page in the order shown in FIG. 7B or FIG. 8B according to the sheet discharge portion (discharge destination of the product (sheet P after the double-sided printing)) which is specified by the sheet discharge port data 404 of the print job. The CPU 1000 makes this determination according to whether or not the printing is performed by the last image data of this even-numbered page.

If it is determined that the printing of the even-numbered page is not completed (Step S301: N), the CPU 1000 feeds the sheet from the cassette 100 which is specified by the sheet feeding port data 403 of the print job by the print control unit 1010 (Step S310). The CPU 1000 prints the even-numbered page of the image data on the first side of the sheet P by the print control unit 1010 (Step S311). The CPU 1000 discharges the sheet P having the first side printed to the sheet discharge portion which is specified by the sheet discharge data 404 of the print job by the print control unit 1010 (Step S312). If the FD sheet discharge portion 5 is specified, the printing of the even-numbered page is performed in the order shown in FIG. 7B. If the FU sheet discharge portion 7 is specified, the printing of the even-numbered page is performed in the order shown in FIG. 8B. The CPU 1000 repeatedly performs the processing of the steps S101, S301, S310 through S312 until the printing of the even-numbered page is completed.

If it is determined that the printing of the even-numbered page is completed (S301: Y), the CPU 1000 determines whether the printing of the odd-numbered page of the image data is started or not (Step S302). If it is determined that the printing of the odd-numbered page is not yet started (Step S302: N), the CPU 1000 displays the operation message for performing the printing of the second side in the manual double-sided printing which is illustrated in FIG. 6B on the operation part 250 (Step S303). The operation message of the present embodiment instructs the user to set the sheet P having the even-numbered page printed on the first side in the manual feed tray 200. The CPU 1000 waits until the sheet P is set in the manual feed tray 200 (Step S304: N).

The CPU 1000 detects that the sheet P is set in the manual feed tray 200 according to the detection result of the manual feed tray sheet presence/absence sensor 203. If the sheet P is set in the manual feed tray 200 (Step S304: Y), the CPU 1000 waits until an "execution" key 601 in the operation message is pressed (Step S305: N). If the "execution" key 601 in the operation message is pressed (Step S305: Y), the CPU 1000 clears the operation message displayed on the operation part 250 (Step S306). The CPU 1000 starts printing the odd-numbered page of the image data on the second side of the sheet P which is set in the manual feed tray 200 by the print control unit 1010 (Step S307). The CPU 1000 performs the printing of the odd-numbered page in the order shown in FIG. 7C or FIG. 8C according to the sheet discharge portion (discharge destination of the product (sheet P after the double-sided printing)) which is specified by the sheet discharge port data 404 of the print job. The CPU 1000 discharges the sheet P having the second side printed to the sheet discharge portion which is specified by the sheet discharge port data 404 of the print job by the print control unit 1010 (Step S312).

After discharging the first double-sided printed sheet P, the CPU 1000 performs the processing of the steps S101, S301, and S302. Here, the printing of the odd-numbered page of the image data is started (Step S302: Y) so that the CPU 1000 determines whether the printing of the odd-numbered page of the image data included in the print job is completed or not (Step S320). If it is determined that the printing of the odd-numbered page is not completed (Step S320: N), the CPU 1000 feeds the sheet P having the even-numbered page printed which is set in the manual feed tray 200 by the print control unit 1010 (Step S321). The CPU 1000 prints the odd-numbered page of the image data on the sheet P having the even-numbered page printed on the first side by the print control unit 1010 (Step S322). The CPU 1000 discharges the sheet P having the second side printed to the sheet discharge portion which is specified by the sheet discharge port data 404 of the print job by the print control unit 1010 (Step S312). The CPU 1000 repeatedly performs the processing of the steps S101, S301, S302, S320, S322, and S312 until the printing of the odd-numbered page is completed. When the printing of the odd-numbered page is completed (Step S320: Y), the CPU 1000 ends the processing.

In the present embodiment, as illustrated in FIG. 7A and FIG. 8A, one sheet circulation in which the double-sided printing is performed in the order of the even-numbered page to the odd-numbered page has been described, however, the embodiment is not limited to this. The present embodiment is applicable to the double-sided printing of other imposition such as well known two-sheet circulation in which the double-sided printing is performed in the order of the even-numbered page (the first side of the first sheet), the even-numbered page (the first side of the second sheet), the odd-numbered page (the second side of the first sheet), the even-numbered page (the first side of the third sheet), the odd-numbered page (the second side of the second sheet) and the like.

In the present embodiment, in the first side printing in the manual double-sided mode, the printer 1 prints the even-numbered page on the sheet P fed from the cassette 100. The user sets the sheet P having the even-numbered page printed in the manual feed tray 200. Thereafter, as the second side printing, the printer 1 prints the odd-numbered page on the sheet P which is set in the manual feed tray 200.

Embodiment 2 of Image Forming Processing

Figure 9:
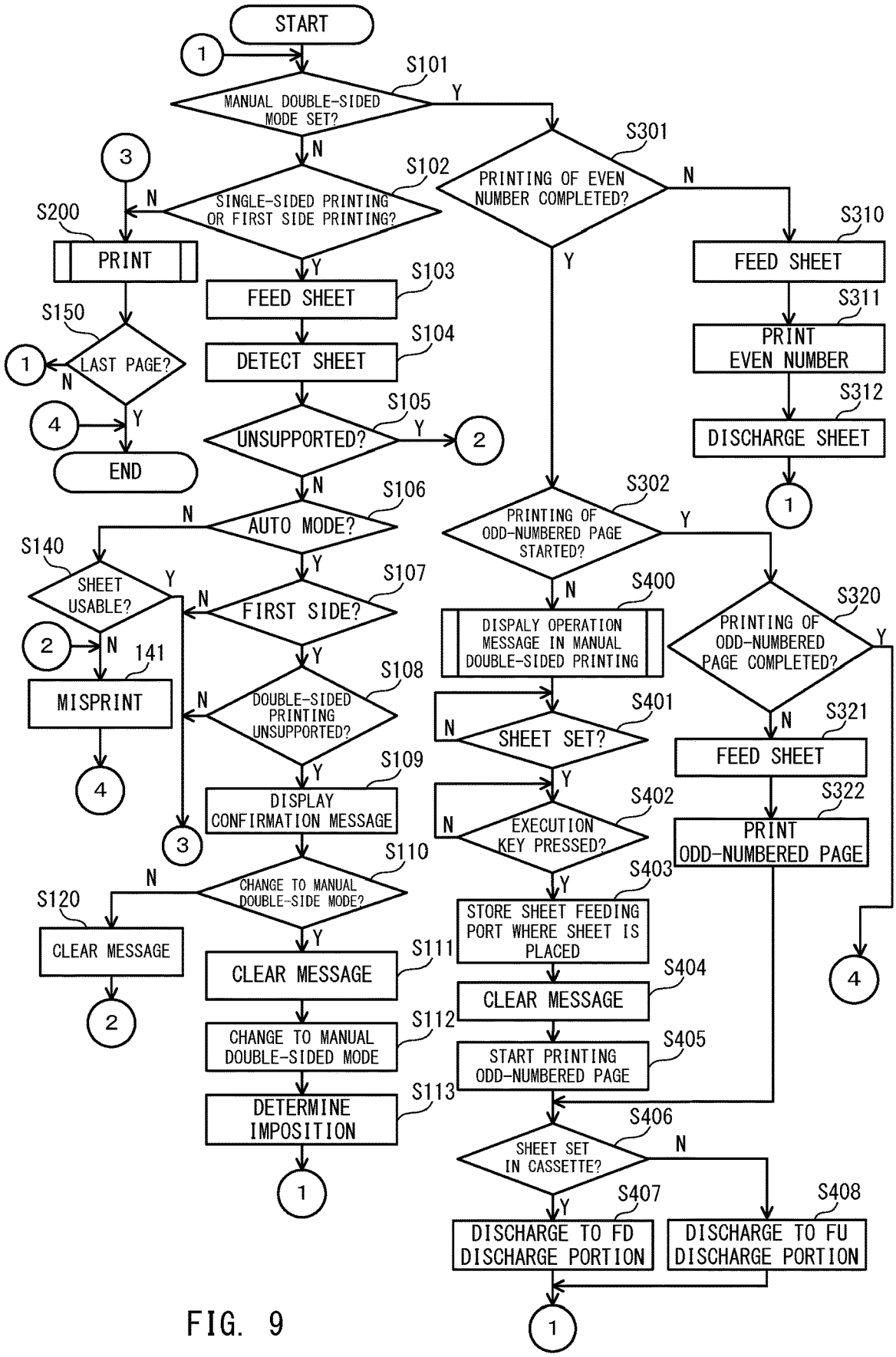
FIG. 9 is a flow chart showing image forming processing

FIG. 9 is another flowchart showing an image forming process (printing processing) by the printer 1. In FIG. 9, the same step numbers are assigned to the same processing as those shown in FIG. 4. To describe briefly, the difference from the processing shown in FIG. 4 will be described. This processing is started when the CPU 1000 acquires the print job from the operation part 250 or the external device 1100. The CPU 1000 stores the acquired print job in the RAM 1002 and performs the processing in accordance with the stored print job. In this processing, the CPU 1000 determines the type of the sheet P from the detection result of the media sensor 240. If the sheet P does not support the double-sided printing, the CPU 1000 displays the operation message on the output device of the operation part 250. The printer 1 outputs the printing product according to the user's response to the operation message.

The CPU 1000 determines whether the manual double-sided mode is set or not (Step S101). The manual double-sided mode of the present embodiment is a print mode of performing the double-sided printing in which the user manually moves the sheet from the sheet discharge port to the cassette 100 or the manual feed tray 200 after the first side is printed and then, the second side is printed according to the user's instruction. It is noted that if the sheet is placed on the cassette 100, the image-formed side of the sheet is placed upward. If the sheet is placed on the manual feed tray 200, the image-formed side of the sheet is placed downward. If the double-sided printing is instructed by the print job and the sheet does not support the double-sided printing, the CPU 1000 sets the manual double-sided mode according to the user's instruction.

The processing of the steps S101 through S113, S200, S150, S140, S141, S120, S301, S302, S310 through S312, and S320 through S322 are the same processing as those shown in FIG. 4 except for the imposition change processing performed in the step S113.

Figure 10A:
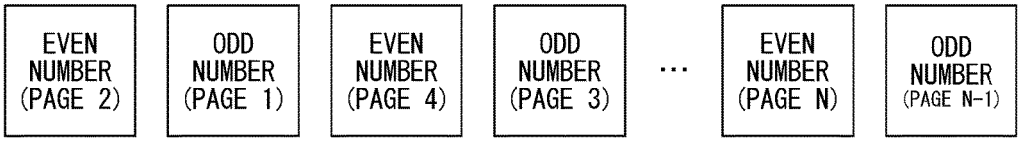
FIG. 10A, FIG. 10B, FIG. 10C, and FIG. 10D are diagrams for explaining the imposition.
Figure 10B:
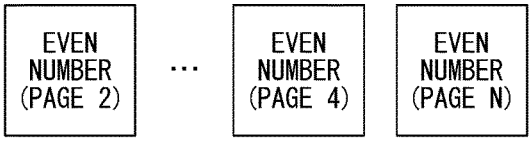
Figure 10C:
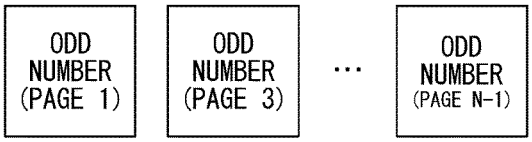
Figure 10D:
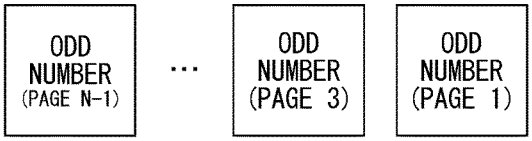
Figure 11A:
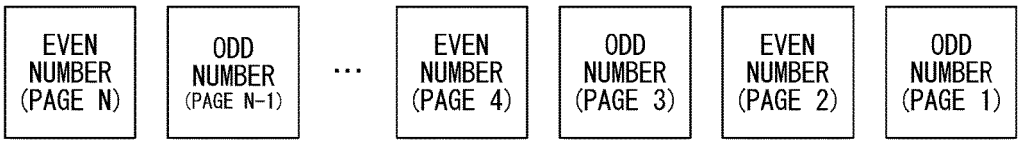
FIG. 11A, FIG. 11B, FIG. 11C, and FIG. 11D are diagrams for explaining the imposition.
Figure 11B:
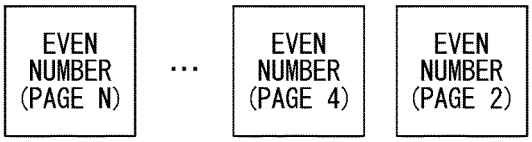
Figure 11C:
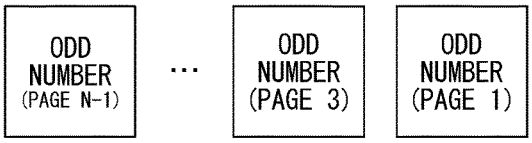
Figure 11D:
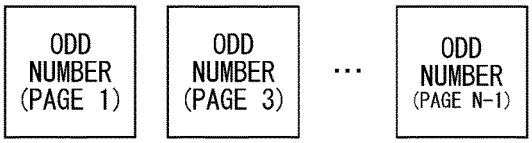

FIG. 10A through FIG. 10D and FIG. 11A through FIG. 11D are explanatory diagrams of the imposition. FIG. 10A and FIG. 11A show the imposition in the normal double-sided printing and show the number of sheets required for the printing. N represents a last page number of the image data. FIG. 10B, FIG. 10C and FIG. 10D and FIG. 11B, FIG. 11C, and FIG. 11D show the imposition in the manual double-sided printing of the present embodiment. The discharge destination of the sheet P differs between the imposition shown in FIG. 10A and FIG. 10B and the imposition shown in FIG. 11A and FIG. 11B. The imposition shown in FIG. 10C and FIG. 10D and the imposition shown in FIG. 11C and FIG. 11D show the imposition according to the sheet feeding port on which the sheet P is placed after the first side is printed. Detailed description will be provided in the following.

FIG. 10A through FIG. 10D show the imposition when the sheet P after the double-sided printing is discharged to the FD sheet discharge portion 5. FIG. 10A shows the imposition when the automatic double-sided printing is performed on the sheet which supports the double-sided printing. The image data is assigned in the order of the even-numbered page to the odd-numbered page from the smaller page number.

FIG. 10B, FIG. 10C, and FIG. 10D show the imposition in the manual double-sided printing of the present embodiment. In FIG. 10B, the image data in the first side printing is rearranged to the even-numbered page from the smaller page number. In the configuration in which the exposure of the image for the first sheet is started before the type of the sheet P is confirmed by the media sensor 240, if it is determined that the sheet P is a sheet which does not support the double-sided printing, the toner image for the first sheet which is already formed on the image carrier 31 can be used as it is.

FIG. 10C shows the imposition when the sheet P is placed on the cassette 100 after the first side is printed. The image data in the second side printing is rearranged to the odd-numbered page from the smaller page number. FIG. 10D shows the imposition when the sheet P is placed on the manual feed tray 200 after the first side is printed. The image data in the second side printing is rearranged to the odd-numbered page from the larger page number.

FIG. 11A through FIG. 11D show the imposition when the sheet P after the double-sided printing is discharged to the FU sheet discharge portion 7. FIG. 11A shows the imposition when the automatic double-sided printing is performed on the sheet which supports the double-sided printing. The image data is assigned in the order of the even-numbered page to the odd-numbered page from the larger page number.

FIG. 11B. FIG. 11C, and FIG. 11D show the imposition in the manual double-sided printing of the present embodiment. In FIG. 11B, the image data in the first side printing is rearranged to the even-numbered page from the larger page number. In the configuration in which the exposure of the image for the first sheet is started before the type of the sheet P is confirmed by the media sensor 240, if it is determined that the sheet P is a sheet which does not support the double-sided printing, the toner image for the first sheet which is already formed on the image carrier 31 can be used as it is.

FIG. 11C shows the imposition when the sheet P is placed on the manual feed tray 200 after the first side is printed. The image data in the second side printing is rearranged to the odd-numbered page from the larger page number. FIG. 11D shows the imposition when the sheet P is placed on the cassette 100 after the first side is printed. The image data in the second side printing is rearranged to the odd-numbered page from the smaller page number. The imposition processing of the step S113 is performed as described above.

Figure 12:
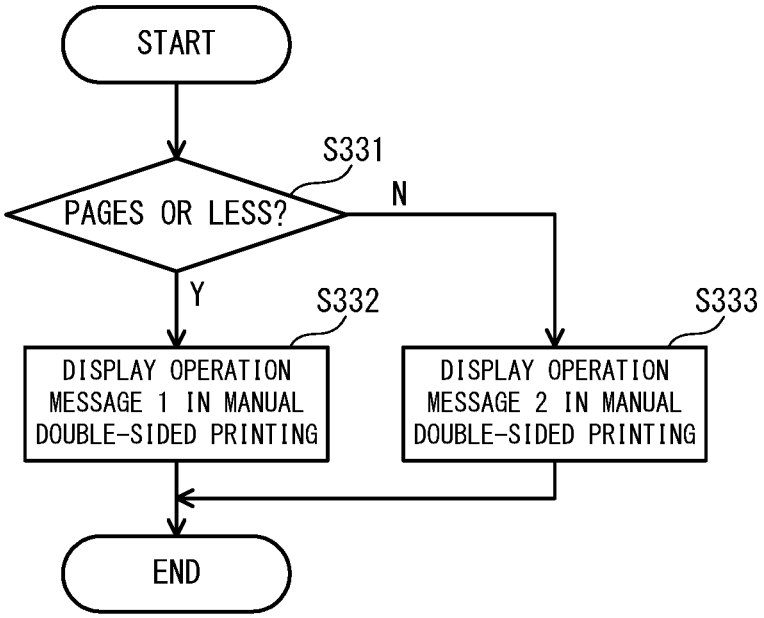
FIG. 12 is a flow chart showing display processing of an operation message.
Figure 13A:
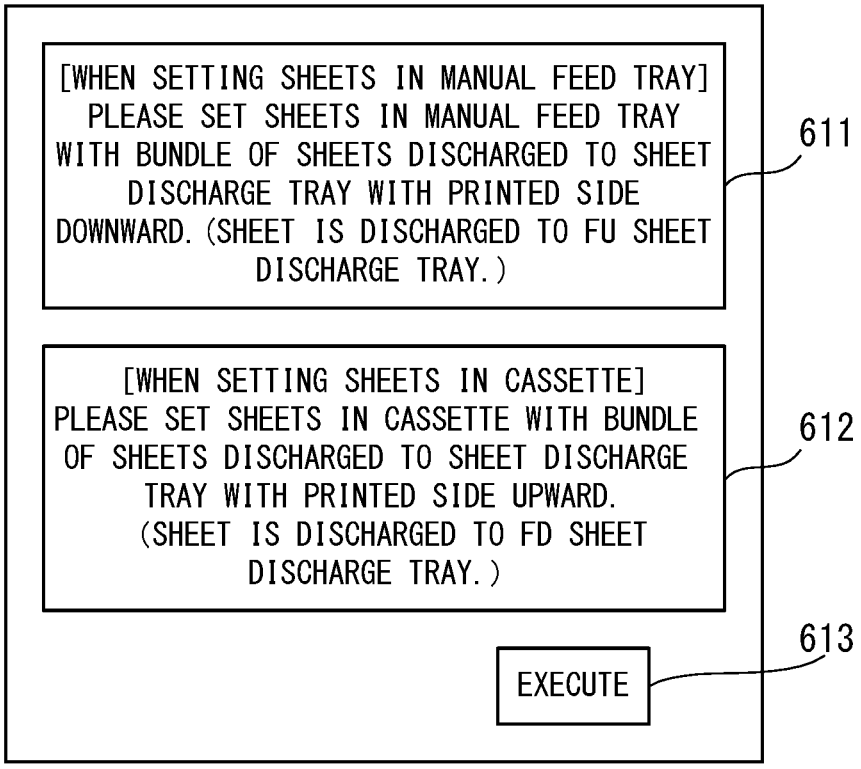
FIG. 13A and FIG. 13B are diagrams each illustrating an operation message.
Figure 13B:
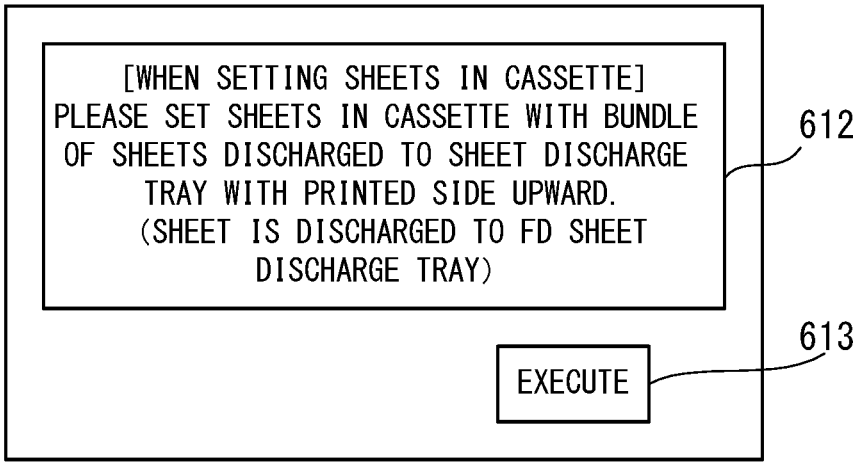

If it is determined that the printing of the even-numbered page is completed and the printing of the odd-numbered page is not yet started (Step S302: N), the CPU 1000 displays the operation message for performing the printing of the second side in the manual double-sided printing on the operation part 250 (Step S400). FIG. 12 is a flow chart showing display processing of the operation message which is performed in the processing of the step S400. FIG. 13A and FIG. 13B are diagrams each illustrating the operation message.

If the operation message is displayed, the CPU 1000 determines whether the even-numbered page is 100 pages or less or not by the print job (Step S331). If it is determined that the even-numbered page is 100 pages or less (Step S331: Y), the CPU 1000 displays the operation message for performing the printing of the second side in the manual double-sided printing illustrated in FIG. 13A on the operation part 250 (Step S332). Here, an operation message 611 when setting the sheet in the manual feed tray 200 and an operation message 612 when setting the sheet in the cassette 100 are displayed.

If it is determined that the printed page exceeds 100 pages (Step S331: N), the CPU 1000 displays the operation message for performing the printing of the second side in the manual double-sided printing illustrated in FIG. 13B on the operation part 250 (Step S333). Here, considering the number of sheets which can be set in the manual feed tray 200, only the operation message 612 when setting the sheet in the cassette 100 is displayed.

The display processing of the operation message of the step S400 is performed as described above. The operation message of the present embodiment instructs the user that the sheet P having the even-numbered page printed on the first side can be set in the cassette 100 or the manual feed tray 200. The CPU 1000 waits until the sheet P is set in the cassette 100 or the manual feed tray 200 (Step S401: N).

The CPU 1000 detects that the sheet P is set in the cassette 100 according to the detection result of the cassette sheet presence/absence sensor 103. In addition, the CPU 1000 detects that the sheet P is set in the manual feed tray 200 by the detection result of the manual feed tray sheet presence/absence sensor 203. If the sheet P is set in the cassette 100 or the manual feed tray 200 (Step S401: Y), the CPU 1000 waits until the "execution" key 613 in the operation message is pressed (Step S402: N). If the "execution" key 613 in the operation message is pressed (Step S402: Y), the CPU 1000 stores the sheet feeding port in which the sheet is set in the RAM 1002 (Step S403). The CPU 1000 clears the operation message displayed on the operation part 250 (Step S404).

The CPU 1000 starts printing the odd-numbered page of the image data on the second side of the sheet P which is set in the cassette 100 or the manual feed tray 200 by the print control unit 1010 (Step S405). The CPU 1000 performs the printing of the odd-numbered page in the order of the imposition shown in FIG. 10C and FIG. 10D or FIG. 11C and FIG. 11D according to the sheet feeding port in which the sheet P is set.

The CPU 1000 determines the sheet feeding port in which the sheet P is set according to the sheet feeding port in which the sheet P stored in the RAM 1002 is set (Step S406). If it is determined that the sheet P is set in the cassette 100 (Step S406: Y), the CPU 1000 discharges the sheet P having the second side printed to the FD sheet discharge portion 5 (Step S407). If it is determined that the sheet P is set in the manual feed tray 200 (Step S406: N), the CPU 1000 discharges the sheet P having second side printed to the FU sheet discharge portion 7 (Step S408).

After discharging the first double-sided printed sheet P, the CPU 1000 performs the processing of the steps S101, S301, and S302. Thereafter, the printing of the odd-numbered page is performed by the same processing as the steps S320 through S322 shown in FIG. 4.

In the present embodiment, as illustrated in FIG. 10A and FIG. 11A, one sheet circulation in which the double-sided printing is performed in the order of the even-numbered page to the odd-numbered page has been described, however, the present embodiment is not limited to this. The present embodiment is applicable to the double-sided printing of other imposition such as well known two-sheet circulation in which the double-sided printing is performed in the order of the even-numbered page (the first side of the first sheet), the even-numbered page (the first side of the second sheet), the odd-numbered page (the second side of the first sheet), the even-numbered page (the first side of the third sheet), the odd-numbered page (the second side of the second sheet) and the like.

In the present embodiment, the printer 1 prints the even-numbered page on the sheet P fed from the cassette 100 in the first side printing in the manual double-sided mode. The user sets the sheet P having the even-numbered page printed in the cassette 100 or the manual feed tray 200. Thereafter, as the second side printing, the printer 1 prints the odd-numbered page on the sheet P which is set in the cassette 100 or the manual feed tray 200.

The printer 1 of the present embodiment as described above determines whether the sheet is supported for the double-sided printing or not according to the detection result of the media sensor 240. If it is determined that the sheet is not supported for the double-sided printing, the printer 1 operates in the manual double-sided mode in which the user sets the sheet having the image formed on one side and changes the order of the page of the image data for the double-sided printing. As a result, the double-sided printing can be performed while suppressing the consumption of the sheet P.

Since the double-sided printing is performed by changing the order of the page of the image data, the user can obtain a desired double-sided printed product. Further, in the configuration in which the exposure of the image for the first sheet is started before the type of the sheet P is confirmed by the media sensor 240, if it is determined that the sheet P is not supported for the double-sided printing, the toner image which is already formed on the image carrier 31 can be used as it is. As a result, erasure of the toner image which is already formed is not needed, which enables prompt printing. In addition, the double-sided printing without any waste of the toner consumption can be achieved.

In the manual double-sided mode, it is not necessary to convey the sheet in the double-sided conveying part 6. This eliminates the need for mechanical changes such as the conveying path of the double-sided conveying part 6. Thus, the double-sided printing on a type of sheet which is not supported for the automatic double-sided printing becomes possible without cost increase. Further, even in a miniaturized printer which does not include the double-sided conveying part 6, by switching to the manual double-sided mode, the double-sided printing can be performed. As described above, the printer 1 of the present embodiment can perform the double-sided printing while suppressing the consumption of sheet by switching to the manual double-sided mode even if the sheet does not support the automatic double-sided printing in performing the double-sided printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-084182, filed Apr. 25, 2018 and No. 2019-040916, filed Mar. 6, 2019 which are hereby incorporated by reference herein in their entirety.

What is claimed is:

1. An image forming apparatus configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the image forming apparatus comprising:

a feeder configured to feed the recording material;

an image forming unit configured to form an image on the recording material according to image data;

a discharge tray to which the recording material with the image formed is discharged, the discharge tray including a first discharge tray to which a side with an image of an odd-numbered page of the recording material formed is discharged downward, and a second discharge tray to which a side with an image of an odd-numbered page of the recording material formed is discharged upward;

a detector configured to detect a characteristic of the recording material in a conveying path after the recording material is fed by the feeder; and a controller configured to determine whether the recording material supports the double-sided printing or not based on a detection result of the detector for the recording material fed by the feeder;

wherein the controller is further configured to determine a printing order of an odd-numbered page and an even-numbered page according to a discharge tray specified by the print job, to control the image forming unit to form an image of an even-numbered page of the print job on the first side of the recording material in an order of page number, to discharge a recording material with an image formed on a first side to the specified discharge tray, to prompt a user to place the discharged recording material on a feeder for second side printing, and to control the image forming unit to form an image of an odd-numbered page on the second side of the recording material with the image formed on the first side which is fed from the feeder for the second side printing in a case where it is determined that double-sided printing is specified by the print job and the recording material does not support the double-sided printing based on a detection result of the detector after the recording material is fed by the feeder.

2. The image forming apparatus according to claim 1, wherein the controller is further configured to perform notification to the user notifying that the recording material does not support the double-sided printing and prompting to place the recording material with an image formed on the first side and discharged to the discharge tray on a feeder for the second side printing in a case where it is determined that the recording material does not support the double-sided printing.

3. The image forming apparatus according to claim 2, wherein the controller performs a first notification as the notification prompting to place the recording material on the feeder in a case where it is determined that the recording material does not support the double-sided printing and the number of printed pages of the print job is a predetermined value or less, and the controller performs a second notification as the notification prompting to place the recording material on the feeder in a case where the number of printed pages of the print job exceeds the predetermined value.

4. The image forming apparatus according to claim 2, wherein the controller is further configured to end the print job without controlling the image forming unit to form an image in a case where the user does not instruct to perform processing in response to the notification.

5. An image forming apparatus configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the image forming apparatus comprising:

a feeder configured to feed the recording material, the feeder including a first feeder on which the recording material that an image of an even-numbered page is formed is placed facing downward and a second feeder on which the recording material that an image of an even-numbered page is formed is placed facing upward, an image forming unit configured to form an image on the recording material according to image data;

a discharge tray to which the recording material with the image formed is discharged, a detector configured to detect a characteristic of the recording material in a conveying path after the recording material is fed by the feeder; and a controller configured to determine whether the recording material supports the double-sided printing or not based on a detection result of the detector for the recording material fed by the feeder;

wherein the controller is further configured to control the image forming unit to form an image of an even-numbered page of the print job on the first side of the recording material in an order of page number, to discharge a recording material with an image formed on a first side to a discharge tray, to prompt a user to place the discharged recording material on a feeder for second side printing, to determine a printing order of an odd-numbered page according to one feeder to be used between the first feeder and the second feeder, and to control the image forming unit to form an image of an odd-numbered page on the second side of the recording material with the image formed on the first side which is fed from the feeder for the second side printing in a case where it is determined that double-sided printing is specified by the print job and the recording material does not support the double-sided printing based on a detection result of the detector after the recording material is fed by the feeder.

6. The image forming apparatus according to claim 5, wherein the discharge tray includes a first discharge tray and a second discharge tray;

wherein the controller is further configured to select the discharge tray as a discharge destination of a recording material with an image of an odd-numbered page formed according to a feeder, among the first feeder and the second feeder, to be used.

7. An image forming apparatus configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the print job including print mode data indicating a print mode for performing printing according to a characteristic of a recording material, the image forming apparatus comprising:

a feeder configured to feed the recording material, an image forming unit configured to form an image on the recording material according to image data;

a discharge tray to which the recording material with the image formed is discharged, a detector configured to detect a characteristic of the recording material in a conveying path after the recording material is fed by the feeder; and a controller configured to determine whether the recording material supports the double-sided printing or not based on a detection result of the detector for the recording material fed by the feeder;

wherein the controller is further configured to control the image forming unit to form an image of an even-numbered page of the print job on the first side of the recording material in an order of page number, to discharge a recording material with an image formed on a first side to a discharge tray, to prompt a user to place the discharged recording material on a feeder for second side printing, and to control the image forming unit to form an image of an odd-numbered page on the second side of the recording material with the image formed on the first side which is fed from the feeder for the second side printing in a case where it is determined that double-sided printing is specified by the print job and the recording material does not support the double-sided printing based on a detection result of the detector after the recording material is fed by the feeder, and wherein the controller is further configured to control the image forming unit to form an image in a case where the characteristic of the recording material supports a print mode indicated by the print mode data, and to end processing without controlling the image forming unit to form an image in a case where the characteristic of the recording material does not support the print mode.

8. The image forming apparatus according to claim 7, wherein the controller is further configured to control the image forming unit to start forming an image on a first side of the recording material in a case where the double-sided printing is specified by the print job and the recording material does not support the double-sided printing.

9. An image forming method which is performed by an image forming apparatus which comprises a feeder configured to feed a recording material, an image forming unit configured to form an image on the recording material according to image data, a discharge tray to which the recording material with the image formed is discharged, the discharge tray including a first discharge tray to which a side with an image of an odd-numbered page of the recording material formed is discharged downward, and a second discharge tray to which a side with an image of an odd-numbered page of the recording material formed is discharged upward, and a detector configured to detect a characteristic of the recording material fed by the feeder, and configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the method comprising:

determining whether the recording material supports the double-sided printing or not based on a detection result of the detector for the recording material in a conveying path after the recording material is fed by the feeder, determining a printing order of an odd-numbered page and an even-numbered page according to a discharge tray specified by the print job, forming, by the image forming unit, an image of an even-numbered page of the print job on the first side of the recording material in an order of page number and discharging a recording material with an image formed on a first side to the specified discharge tray in a case where it is determined that double-sided printing is specified by the print job and the recording material does not support the double-sided printing after the recording material is fed by the feeder, prompting a user to place the discharged recording material on a feeder for second side printing, and forming, by the image forming unit, an image of an odd-numbered page on the second side of the recording material with the image formed on the first side which is fed from a feeder for the second side printing.

10. An image forming method which is performed by an image forming apparatus which comprises a feeder configured to feed a recording material, the feeder including a first feeder on which the recording material that an image of an even-numbered page is formed is placed facing downward and a second feeder on which the recording material that an image of an even-numbered page is formed is placed facing upward, an image forming unit configured to form an image on the recording material according to image data, a discharge tray to which the recording material with the image formed is discharged, and a detector configured to detect a characteristic of the recording material fed by the feeder, and configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the method comprising:

determining whether the recording material supports the double-sided printing or not based on a detection result of the detector for the recording material in a conveying path after the recording material is fed by the feeder, forming, by the image forming unit, an image of an even-numbered page of the print job on the first side of the recording material in an order of page number and discharging a recording material with an image formed on a first side to a discharge tray in a case where it is determined that double-sided printing is specified by the print job and the recording material does not support the double-sided printing after the recording material is fed by the feeder, prompting a user to place the discharged recording material on a feeder for second side printing, determining a printing order of an odd-numbered page according to one feeder to be used between the first feeder and the second feeder, and forming, by the image forming unit, an image of an odd-numbered page on the second side of the recording material with the image formed on the first side which is fed from a feeder for the second side printing.

11. An image forming method which is performed by an image forming apparatus which comprises a feeder configured to feed a recording material, an image forming unit configured to form an image on the recording material according to image data, a discharge tray to which the recording material with the image formed is discharged, and a detector configured to detect a characteristic of the recording material fed by the feeder, and configured to perform, based on a print job to be input, double-sided printing in which front and back of a recording material is reversed on a conveying path after a first side of the recording material is printed and thereafter a second side of the recording material is printed, or single-sided printing in which a first side of a recording material is printed and the recording material is discharged, the print job including print mode data indicating a print mode for performing printing according to a characteristic of a recording material, the method comprising:

determining whether the recording material supports the double-sided printing or not based on a detection result of the detector for the recording material in a conveying path after the recording material is fed by the feeder, forming, by the image forming unit, an image of an even-numbered page of the print job on the first side of the recording material in an order of page number and discharging a recording material with an image formed on a first side to a discharge tray in a case where it is determined that double-sided printing is specified by the print job and the recording material does not support the double-sided printing after the recording material is fed by the feeder, prompting a user to place the discharged recording material on a feeder for second side printing, forming, by the image forming unit, an image of an odd-numbered page on the second side of the recording material with the image formed on the first side which is fed from a feeder for the second side printing, and forming an image in a case where the characteristic of the recording material supports a print mode indicated by the print mode data, and to end processing without controlling the image forming unit to form an image in a case where the characteristic of the recording material does not support the print mode.

* * * * *